United States Patent [19]

Kaieda et al.

[11] Patent Number: 4,928,055

[45] Date of Patent: May 22, 1990

[54] CONTROL CIRCUIT FOR HEAT FIXING DEVICE FOR USE IN AN IMAGE FORMING APPARATUS

[75] Inventors: Shozo Kaieda, Hachioji; Ikuo Kurashima, Tama; Hideo Okazima, Tama; Jun Mai, Tama, all of Japan

[73] Assignee: Kentek Information Systems, Inc., Allendale, N.J.

[21] Appl. No.: 316,512

[22] Filed: Feb. 28, 1989

[30] Foreign Application Priority Data

Nov. 25, 1988 [JP] Japan ..... 63-296247

[51] Int. Cl.[5] ..... G05F 5/00

[52] U.S. Cl. ..... 323/300; 323/235; 323/319

[58] Field of Search ..... 323/299, 300, 235, 237, 323/239, 241, 319, 320, 322, 324; 363/142, 143

[56] References Cited

U.S. PATENT DOCUMENTS

| | | | |
|---|---|---|---|
| 4,289,948 | 9/1981 | Jurek et al. | 323/300 |
| 4,377,739 | 3/1983 | Eckert, Jr. et al. | 323/235 |
| 4,689,548 | 8/1987 | Mechlenburg | 323/300 |

*Primary Examiner*—Peter S. Wong

*Attorney, Agent, or Firm*—Marmorek, Guttman & Rubenstein

[57] ABSTRACT

A control circuit for heat fixing device for use in an image forming apparatus is disclosed. The control circuit comprises device for detecting a power source voltage, device for detecting zero-crossing points of the power source voltage, device for determining frequency of the source voltage from the detected zero-crossing points, device for determining a power supplying time based on the detected power supply voltage and the power source frequency, device for controlling the power supply to a load based on the determined power supply line, in such a manner that a given power is automatically applied to the load against the change or fluctuation of the power supply source.

7 Claims, 3 Drawing Sheets

CONTROL CIRCUIT FOR HEAT FIXING DEVICE FOR USE IN AN IMAGE FORMING APPARATUS

BACKGROUND OF THE INVENTION

The present invention relates to a power supplying circuit, more particularly, a control circuit for heat fixing device capable of automatically supplying a certain voltage previously determined to a load even though a specification of power supply voltage is changed In a copying machine and a printing apparatus, a heat fixing device such as an oven fixing device and heat roll fixing device is utilized to fix a toner image transferred onto a record paper. Such a heat fixing device utilizes, for example, a halogen lamp having a rated output of 1 KW as a heat source, and a toner image is fused and fixed onto the record paper with the use of heat emitted therefrom. The halogen lamp for use in the heat fixing device has a load resistance value fixed for the rated power supply voltage, so that if the input voltage of the lamp is changed or fluctuated with time, the power consumption becomes changed While the voltage of commercial power source is different each country, so that when the products for the apparatus are exported to many country, the specification of the halogen lamp or power source circuit must be adapted to that of the commercial power source voltage of each country. In the conventional copying machine and the printing apparatus, therefore, every commercial power source voltage of each country, respective halogen lamps having different load resistance values are utilized, or a large power controlling transformer is incorporated in the power circuit to step down the commercial power source to the rated voltage of lamp.

As described above, in the method of in corporating the halogen lamp having different specifications into the heat fixing device every different commercial power voltage, halogen lamps having various kinds of specifications must be supplied to the production line and administrated, so that the management of production steps becomes difficult and complicated While, in the method of incorporating the control transformer in the power circuit, to step down the commercial power voltage to the rated voltage of lamp, and of applying the thus obtained rated voltage to the halogen lamp, even if the commercial power voltage is changed, the halogen lamp having same specifications can be used, but production cost becomes high, because of high and large power controlling transformer. Such a defect generates also in case of applying power voltage to the halogen lamp having large consumption power, in addition the case of applying power voltage to the halogen lamp of the heat fixing device.

It is an object of the present invention to eliminate the above described defects It is another object of the present invention to provide a control circuit for use in a heat fixing device capable of applying a certain power voltage automatically to the same load element without using a power supply circuit with complicated construction, even if the power voltage is changed or fluctuated.

SUMMARY OF THE INVENTION

The present invention provides a control circuit for heat fixing device for use in an image forming apparatus comprising means for detecting a power source voltage, means for detecting zero-crossing points of the power source voltage, means for determining frequency of the source voltage from the detected zero-crossing points, means for determining a power supplying time based on the detected power supply voltage and the power source frequency, means for controlling the power supply to a load in accordance with the determined power supply time, whereby a given power is automatically applied to the load against the change or fluctuation of the power supply source.

DETAILED DESCRIPTION OF THE INVENTION

Figure 1:
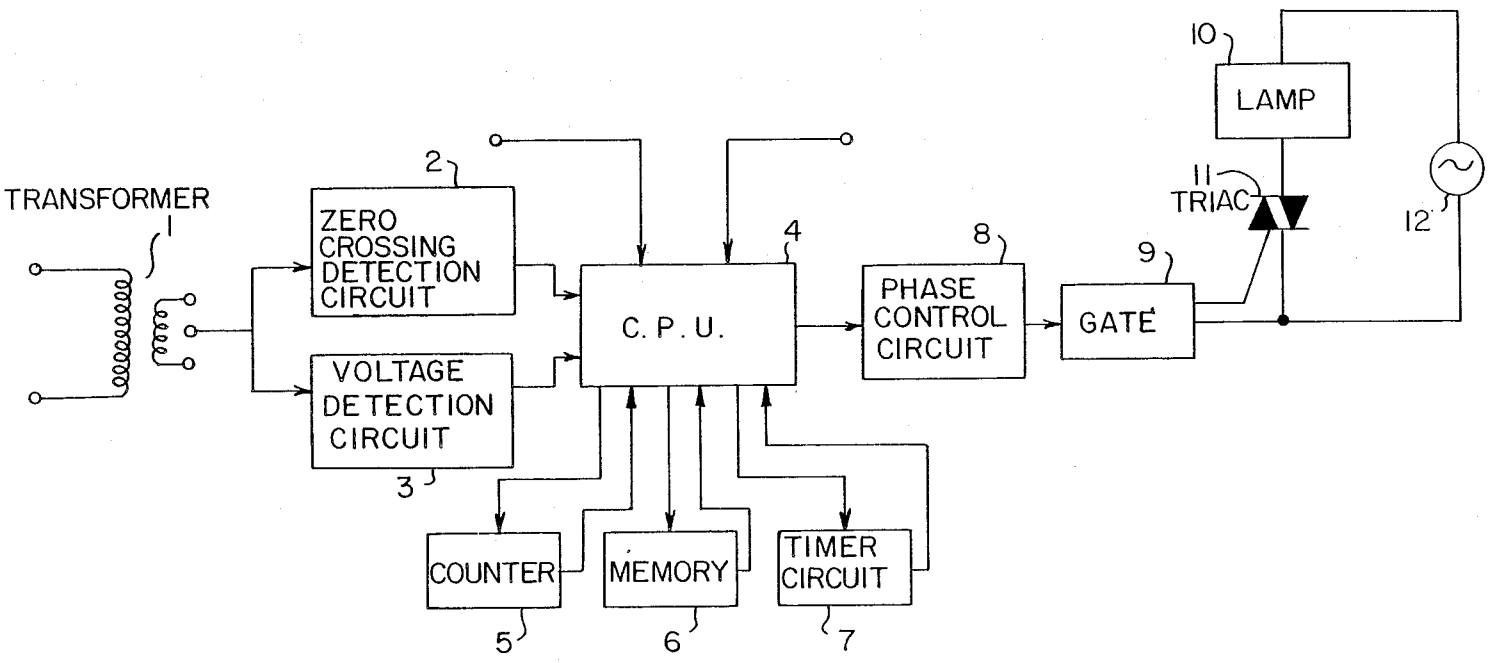
FIG. 1 is a circuit diagram showing the construction of one embodiment of the power supplying circuit according to the present invention.

An alternating power voltage may generally be expressed by following equation.

$$l = \sqrt{2}\ E \sin\theta\ (\mathrm{V})$$

Provided that a power voltage is applied to a load R only at phases of $\alpha \leqq \theta \leqq \pi$, $\pi + \alpha \leqq \theta \leqq 2\pi$, in case of using the above alternating power voltage and of making a phase the power P consumed at the load R may be represented by following equation.

$$\begin{aligned} P &= \frac{1}{2\pi}\left\{ \int_{\alpha}^{\pi} \frac{l^2}{R}\, d\theta + \int_{\pi+\alpha}^{2\pi} \frac{l^2}{R}\, d\theta \right\} \\ &= \frac{1}{\pi} \int_{\alpha}^{\pi} \frac{l^2}{R} = \frac{1}{\pi} \int_{\alpha}^{\pi} \frac{(2\,E \sin\theta)^2}{R}\, d\theta \\ &= \frac{E^2}{R} \cdot \frac{2(\pi - \alpha) + \sin 2\alpha}{2\pi}\ [W] \end{aligned} \tag{1}$$

In the above equation, the power consumption p and the load resistance R are fixed value, so that the power consumption at the load R may always be maintained to constant value by setting an appropriate phase angle $\alpha$ to the voltage value E, even though the voltage value E is changed. The power supplying time during one cycle in which the power voltage must be applied to the load, may also be obtained from the phase angle $\alpha$. For example, the time T from the zero-crossing point of the power voltage to the starting point of the power supply may be obtained from the phase angle $\alpha$ thus obtained. A following table 1 shows an relationship between the time T from the zero-crossing point to the begining point of the power supply and the phase angle to the various kinds of voltage values E in case of setting the rated voltage of the load to 100 V, by taking the case of the commercial power frequencies of 50 Hz and 60 Hz into consideration

TABLE 1

| Voltage E value (V) | Phase angle α (deg) | T (m sec) 50 Hz | T (m sec) 60 Hz |
|---|---|---|---|
| 100 | 0.0 | 0.0 | 0.0 |
| 120 | 71.8 | 3.99 | 3.32 |
| 200 | 113.9 | 6.33 | 5.27 |
| 220 | 118.8 | 6.60 | 5.50 |
| 230 | 120.9 | 6.72 | 5.60 |
| 240 | 122.9 | 6.83 | 5.69 |

According to the above recognization, if the means for detecting the period of zero-crossing points of the power source voltage, the means for detecting the values of the power source voltage, and the memory for storing the contents of the above table 1, in which the relationship of the begining time T of the power supply from the zero-crossing point for the power voltage is represented, are connected to the signal processing unit (CPU), the power supplying time T for said power voltage may be obtained from the detected voltage value and the zero-crossing periods. Then, if the power voltage is applied to the load element according to the thus obtained power supplying time, a certain power voltage may be applied to the load element automatically, even though the specification of the power voltage and the power frequency are changed. As result of this, even though the power voltage is changed, a certain voltage may automatically be applied without changing the resistance value of the load element Moreover, the large power controlling transformer is not used, so that the production cost for the power supplying circuit becomes cheap and the generation of noize may effectively be prevented.

Figure 2:
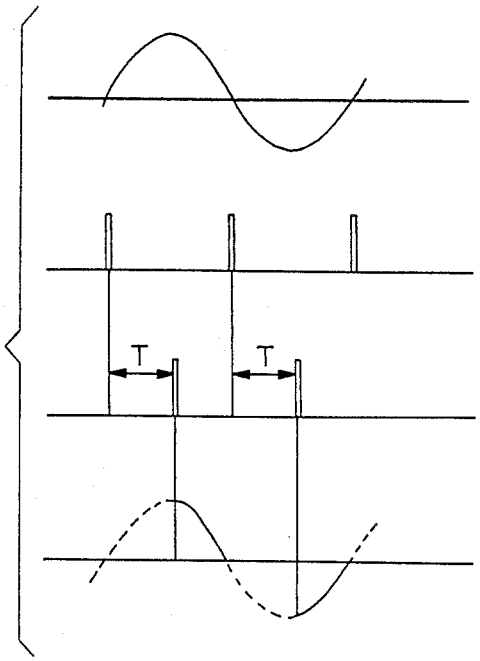
FIG. 2 is a diagram showing zero-crossing pulses, control pulses and waveform of the supplying power, respectively.

FIG. 1 is a circuit diagram showing the construction of one embodiment of the power supply circuit according to the present invention FIG. 2 is a time diagram showing a zero-crossing pulse, control pulse and supply power. This embodiment shows an embodiment in which a power voltage is applied to a halogen lamp for use in a heat roll fixing apparatus for a printing device and a copying machine. A commercial power source is connected to a transformer 1 to step down it to a given voltage, and the dropped voltage is applied to a zero-crossing detection circuit 2 and a voltage detection circuit 3, respectively. The zero-crossing detection circuit 2 detects zero-crossing points of the alternating power source and supplies it to a central processing unit (CpU) 4. The voltage detection circuit 3 detects the voltage value of the power source and supplies it to the CpU 4. The CPU 4 commences to control the power supply by means of the lamp operation signals delivered from the controller provided in the printing device. At first, when the device receives the zero-crossing pulse a counter 5 is reset, to commence its counting immediately thereafter, thereby measuring the time upto next incoming zero-crossing pulse signal. The time of half cycle of the power voltage, therefor, is obtained and determine the frequency of power source. A memory 6 is connected to the CpU 4 and previously stores the contents of the above described table 1, that is, the relation of the time (T) from the zero-crossing points upto the starting point of the power supply for the supply voltage and the supply frequency. The CPU 4 determines the time T from the generation of the zero-crossing palse to the starting point of power supply in accordance with the power source frequency and the detected valtage value as well as the stored contents of the memory. The determined time T is, then, set at a timer circuit 7 and an interrupt signal is generated to the CPU from the time circuit 7 after T second and after generation of the zero-crossing pulse, thereby generating control pulses from the CPU as shown in FIG. Moreover, control pulse is generated when the temperature detected signal from the temperature detecting element for detecting the temperature of the heat roll is less than the set temperature of the heat roll. The control pulse generated from the CPU is applied by a phase control circuit 8 and supplied to a gate circuit 9 as a signal for driving a gating circuit. The gate circuit 9 generates a gate signal for a triac 11 for controlling power supply to a lamp 10, thereby lighting the lamp 10 after T second from the zero-crossing point as shown in FIG. 2, and quenching at next zero-crossing point, thereby supplying power to the lamp 10.

Figure 3:
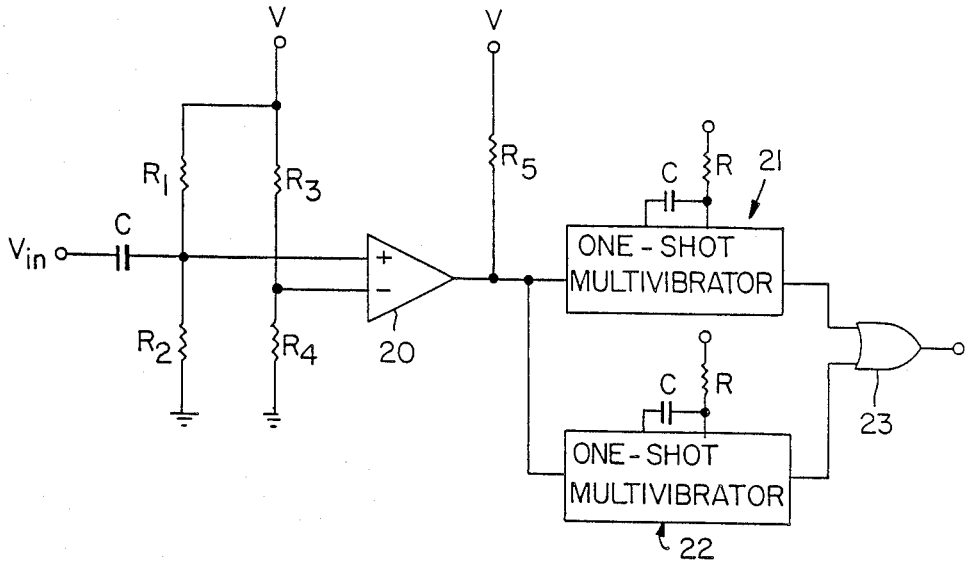
FIG. 3 is a circuit diagram showing the construction of one embodiment of the zero-crossing detection circuit.
Figure 4A:
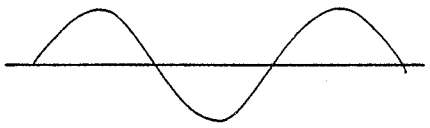
FIGS. 4*a* to 4*c* are diagrams showing pulse waveforms generated in the zero-crossing detection circuit.
Figure 4B:
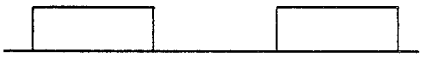
Figure 4C:
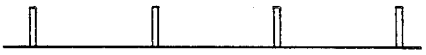

FIG. 3 is a circuit diagram showing a construction of one embodiment of a zero-crossing detection circuit according to the invention and FIGS. 4*a*~4*c* are signal waveform diagram obtained therefrom. In this embodiment, the circuit has an input terminal for power source voltage Vin which is stepped down by the transformer. The input terminal of the zero-crossing detection circuit is connected to the juncton point of series combination of resistors $R_1$ and $R_2$ through a capacitor C, and this junction point is connected to a non-inverted input of a comparator 20. The junction point of the series combination of resistors R' and R is connected to an inverted input of the comparator 20. These two series combinations are connected in parallel with each other and one end thereof is connected to the reference voltage $V_1$ and the other end thereof is grounded. The output of the comparator 20 is connected to the reference voltage V through a resistor $R_5$. These resistors $R_1 \sim R_5$ have an equal resistance value R, respectively. The output of the comparator 20 generates a rectangular wave which is rised and falled with each other at zero-crossing points an shown in FIG. 4*b*. This rectangular wave is supplied to first and second one-shot multivibrator circuits 21 and 22, respectively. Provided that the first multivibtator circuit 21 operates with the leading edge and the second multivibrator circuit 22 operates with the trailing edge. When the outputs of these one-shot multivibrator circuits 21 and 22 are supplied to an OR circuit 23, a zerocrossing pulse corresponding to the zero-crossing point shown in FIG. 4*c* is generated.

Figure 5:
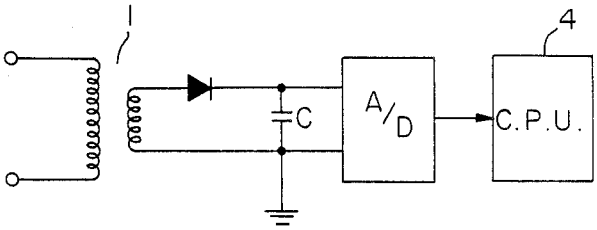
FIG. 5 is a circuit diagram showing the construction of one embodiment of the voltage detection circuit.

FIG. 5 is a circuit diagram showing the construction of one embodiment of the voltage detection circuit 3. The voltage stepped down at given rate by the transformer 1 is applied to an A/D converter 30 through a diode and a parallel connected capacitor C to convert a digital signal corresponding to the power voltage. The digital signal is supplied to the CPU 4 to detect the power voltage in accordance with the data stored in the CpU 4. Accordidng to such a construction, the power voltage may be detected with very simple construction.

The invention may be embodied specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein. For example, the above described embodiment was constructed by obtaining the time T from zero-crossing point to the starting point of the power supply based on the equation (1), to start the power supplying after T sec from the zero-crossing point, but the supplying time itself of the power voltage is obtained in accordance with the equation (1) and the power voltage may be applied to the load over the obtained supplying time from the zero-crossing point. In this case, as soon as the zerocrossing pulse is generated, the power supplying is started, and a control pulse is generated after passing the power supplying time, so that the power supplying is stopped by this control pulse.

Moreover, the above embodiment utilizes the halogen lamp as a load and the power voltage is applied to the halogen lamp, but the present invention may also be applied even in case of applying the power voltage to varrious kinds of loads, as long as the load is one which does not fluctuate load resistance by the input voltage in addition to the halogen lamp.

What is claimed is:

1. A control circuit for a heat fixing device for use in an image forming apparatus comprising means for detecting a power source voltage, means for detecting zerocrossing points of the power source voltage, means for determining a frequency of the source voltage from the detected zero-crossing points, means for determining a power supplying time interval based on the detected power source voltage and the determined power source frequency, means for controlling the power supplied to a load in accordance with the determined power supplying time interval, whereby a given power is automatically applied to the load when the power source voltage or frequency changes, wherein a time from zerocrossing to power supply starting is stored in a memory as data for different values of power source voltage and frequency and the power supplying time interval is determined in accordance with said stored data and the detecting power source voltage as well as the determined power source frequency.

2. A control circuit for a heat fixing device for use in an image forming apparatus as claimed in claim 1, wherein the time from zero-crossing to power supply starting is obtained in accordance with the data stored in the memory and the detected power source voltage as well as the determined power source frequency and the power supplying to the load is performed between the power supply starting time thus obtained and the following zero-crossing.

3. A control circuit for a heat fixing device for use in an image forming apparatus as claimed in claim 2, wherein a control pulse is generated at the start of power supplying thus obtained and the means for controlling is driven in accordance with the control pulse.

4. A control circuit for automatically supplying a predetermined power to a load comprising memory means for storing predetermined information related to a power supplying time interval for different values of a power source voltage and a power source frequency, first detecting means for detecting an actual voltage of an actual power source signal, second detecting means for detecting actual zero crossings of said actual power source signal, processing means in communication with said memory means and said first and second detecting means for determining in response to said actual zero-crossings an actual frequency of said actual power source signal and for determining a specific power supplying time interval utilizing said information stored in said memory and said actual voltage and said actual frequency, and controlling means for controlling the power supplied to said load in accordance with said specific power supplying time interval so that said predetermined power is automatically supplied to said load.

5. The control circuit of claim 4 wherein said specific power supplying time interval is the time interval between one of said actual zero-crossings and the time when power is actually supplied to said load.

6. A control circuit for automatically supplying a predetermined power to a load comprising:

memory means for storing predetermined information related to a power supplying time interval for different values of a power source voltage and a power source frequency, circuit means for determining an actual voltage of an actual power source signal and an actual frequency of said actual power source signal, means in combination with said memory means and said circuit means for determining an actual power supplying time interval by utilizing said actual voltage and said actual frequency to obtain said actual power supplying time interval from said memory, and controlling means for controlling the power supplied to said load in accordance with said actual power supplying time interval so that said predetermined power is automatically supplied to said load.

7. The control circuit of claim 6 wherein said specific power supplying time interval is the time interval between a zero crossing of said actual power signal and the time when power is actually supplied to said load.

* * * * *